US007431598B2

(12) United States Patent
Ikeya et al.

(10) Patent No.: US 7,431,598 B2
(45) Date of Patent: Oct. 7, 2008

(54) LEVER TYPE CONNECTOR

(75) Inventors: Kenichi Ikeya, Shizuoka-ken (JP); Ronald Alan Cabangal, Shizuoka-ken (JP); Hideki Inoue, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/870,576

(22) Filed: Oct. 11, 2007

(65) Prior Publication Data

US 2008/0090435 A1 Apr. 17, 2008

(30) Foreign Application Priority Data

Oct. 12, 2006 (JP) ..... 2006-278599

(51) Int. Cl.
*H01R 13/62* (2006.01)

(52) U.S. Cl. ..... 439/160

(58) Field of Classification Search ..... 439/160, 439/159, 157, 153, 352, 372
See application file for complete search history.

(56) References Cited

U.S. PATENT DOCUMENTS 6,413,105 B2 * 7/2002 Noro et al. ..... 439/157
6,755,674 B2 * 6/2004 Fujii et al. ..... 439/157
7,234,952 B2 * 6/2007 Sasaki et al. ..... 439/157
7,255,581 B2 * 8/2007 Yamaoka ..... 439/157
7,300,294 B2 * 11/2007 Fukatsu et al. ..... 439/157
7,311,535 B2 * 12/2007 Taguchi et al. ..... 439/157
7,351,094 B2 * 4/2008 Miyamoto ..... 439/447

FOREIGN PATENT DOCUMENTS

JP 2004-241157 8/2004

* cited by examiner

*Primary Examiner*—Chandrika Prasad
(74) *Attorney, Agent, or Firm*—Finnegan, Henderson, Farabow, Garrett & Dunner L.L.P.

(57) ABSTRACT

A lever type connector comprises two connector housings, a lever which is rotatably attached to one housing and has cam grooves, and cam pins which are provided on another housing and guided by the cam grooves. Connecting or disconnecting is assisted by rotating the lever with the cam pins and the cam grooves. A lever position, at which the cam pins can be inserted into entry gates of the cam grooves respectively, is set as a start position, and a lever position, at which the housings are completely connected, is set as an end position. An attaching position of the lever, at which the lever can be attached to the one housing, is set outside of an ordinary rotation range from the start position to the end position. According to the lever type connector, it is possible to prevent uncoupling of the lever within the ordinary rotation range.

6 Claims, 15 Drawing Sheets

LEVER TYPE CONNECTOR

BACKGROUND OF THE INVENTION

1. Field of the Invention

The present invention relates to a lever type connector in which male and female connector housings can be connected or disconnected by rotating a lever with only a small operating force.

2. Description of the Related Art

Conventionally, for a connector which requires a large connecting force such as a multi-terminal connector, a lever type connector having a lever for assisting the connecting force has been utilized.

In the lever type connector, a lever having a cam groove on one connector housing is rotatably provided, and a cam pin to be guided by the cam groove is provided on another connector housing. The cam pin is inserted into an entry gate of the cam groove at an initial stage of connecting both connector housings where a lever is positioned at a start position. Next, the cam pin is guided into the can groove by rotating the lever, and then the both housings are firmly connected with a small operating force of the lever by utilizing the principle of leverage.

FIG. 1 to FIG. 4 show one embodiment of a conventional lever type connector described in Japanese Patent Application Laid Open No. 2004-241157. FIG. 1 shows a state before a cam pin 955 is inserted into a cam groove 940. FIG. 2 shows an initial stage of connecting in which the cam pin 955 is inserted into the cam groove 940. FIG. 3 shows an initial stage of rotating a lever 930. FIG. 4 shows a final stage of connecting in which the lever 930 is rotated to an end position.

This lever type connector has a pair of male and female connector housings 910 and 950 to be connected with each other. In each terminal cavity of the connector housings 910 and 950, terminals (not shown in figures) are accommodated. The arch-shaped lever 930 for connecting operation is attached to the connector housing 910 at outer side surface of one connector housing. An axial hole 932 and the cam groove 940 are formed on each base end of the lever 930. A knob 949 is formed on a center of the lever 930.

Each of the cam grooves 940 extends in a prescribed angle range around the axial hole 932 (center of the angle). A distance from the axial hole 932 to the cam groove 940 decreases gradually from an entry gate 941 towards an opposite end. A pin 912, to which the axial hole 932 is rotatably coupled, is provided on each side of the connector housing 910. The lever 930 is rotatably attached by coupling the pins 912 with the axial holes 932 respectively. As a result, the lever 930 will be rotated within a prescribed angle range around the pin 912 (center of the rotation) between start and end positions.

The cam pin 955 to be guided by the cam groove 940 of the lever 930 is provided on each side of the connector housing 950. When a pair of the connector housings 910 and 950 is to be connected, the cam pin 955 is positioned near the entry gate 941 of the cam groove 940 of the lever 930 positioned at the start position.

A pair of tabs 912*a* for preventing the lever 930 from uncoupling is provided on a tip end of each of the pin 912. The pair of tabs 912*a* is extended in mutually opposite directions. A pair of notches 932*a* corresponding to the pair of tabs 912*a* described above is provided with each of the axial hole 932. When the lever 930 is coupled with the connector housing 910, the pins 912 are inserted into the axial hole 932 after aligning the positions of the notches 932*a* and the tabs 912*a*. As a result, the lever 930 is attached to the connector housing 910. When the lever 930 is rotated from this attaching position, the positions of the tabs 912*a* and the notches 932*a* will become unmatched so that the lever 930 would not uncouple from the pins 912. In other words, uncoupling of the lever 930 would be prevented even when an external force applies to the lever 930.

When the above-described connector (the pair of the housings 910, 950) is to be connected, as shown in FIG. 1, the lever 930 is positioned at the start position and the pair of the connector housings 910, 950 is set face to face. Next, as shown in FIG. 2, the connector housings 910, 950 are connected loosely. At this point, the respective cam pin 955 is inserted into the entry gate 941 of the respective cam groove 940. And then, as shown in FIG. 3, the lever 930 is rotated toward the end position by grabbing the knob 949. The respective cam pin 955 is entered into the cam groove 940 from the entry gate 940, and then guided along the cam groove 940. The connector housings 910, 950 are connected by the cam structure between the cam groove 940 and the cam pin 955.

While the lever 930 is rotated, a circumferential edge of the respective axial hole 932 of the lever 930 is held by the respective tabs 912*a*, so that the lever 930 is held without uncoupling. As shown in FIG. 4, the connector housings 910, 950 are completely connected and the male and female terminals inside the cavities are also connected when the lever 930 has been rotated to the end position. On the contrary, the lever 930 is rotated in an opposite direction when the both connector housings 910, 950 are to be disconnected. The both connector housings 910, 950 will be disconnected by the principle of leverage applied between the cam groove 940 and the cam pin 955.

In the above-described lever type connector, the attaching position of the lever 930 is located within an ordinary rotation range of the lever 930 at connecting the connector. In other words, the start position and the attaching position of the lever 930 are coincident. For this reason, there has been a possibility for the lever 930 to uncouple when a lateral load or the like is applied during an operation of the lever 930. The connector could not be connected firmly with a small operating force if the lever 930 uncoupled.

SUMMARY OF THE INVENTION

In view of the above-described situation, the present invention has an object to provide a lever type connector which is capable of surely preventing uncoupling of the lever within an ordinary rotation range of the lever at connecting the connector.

An aspect of the present invention provides a lever type connector which comprises: first and second connector housings to be connected with each other; a lever which is rotatably attached to the first connector housing and has cam grooves; and cam pins which are provided on the second connector housing and guided by the cam grooves respectively. Connecting or disconnecting of the first and second connector housings is assisted by rotating the lever in a state where the cam pins are inserted into the cam grooves respectively. A position of the lever, at which the cam pins can be inserted into entry gates of the cam grooves respectively, is set as a start position of rotation, and a position of the lever, at which the first and second connector housings are completely connected by rotation of the lever, is set as an end position of rotation. An attaching position of the lever, at which the lever can be attached to the first connector housing, is set outside of an ordinary rotation range from the start position to the end position.

According to the aspect of the present invention, since the attaching position of the lever is set outside of the ordinary rotation range, the lever is never rotated to the attaching position by error at the ordinary operation of the lever. The lever can be detached at the attaching position, but the lever is never rotated to the attaching position at the ordinary operation of the lever. Therefore, the lever does not uncouple even if an external force (a lateral load on the lever or the like) applies to the lever at the ordinary operation of the lever (the connector connecting operation). In addition, it is also possible to prevent the uncoupling of the lever by setting a coupling structure between the lever and the first connector housing severely and coupling the lever with the first connector housing forcefully. However, the attaching operation of the lever onto the first connector housing becomes cumbersome. According to the aspect of the present invention, the attaching position of the lever is set specially so that the attaching operation of the lever does not become cumbersome and the attaching operation can be effectively improved.

It is preferable that the lever connector further comprises: holding mechanism which is provided between the lever and the first connector housing and prevents uncoupling of the lever when the lever is positioned within the ordinary rotation range. The holding mechanism is configured to make the lever in an unholding state when the lever is positioned at the attaching position.

In this way, the uncoupling of the lever can be prevented surely by the holding mechanism when the lever is positioned within the ordinary rotation range. On the other hand, since the holding mechanism is in an unholding state when the lever is positioned at the attaching position outside of the ordinary rotation range, the lever can be detached from or attached to the first connector housing.

Here, it is further preferable that the holding mechanism has: a first tab extended from an edge of the lever; and a second tab which is provided on the first connector housing and engaged with the first tab when the lever is positioned within the ordinary rotation range. It is also further preferable that the holding mechanism has: a slit provided on the lever; a hook which is provided on the first connector housing and inserted within the slit slidably; and a third tab which is provided on an inside edge of the slit and engaged with the hook when the lever is positioned within the ordinary rotation range.

It is preferable that the lever connector further comprises: a stopper which is provided on the lever type connector after the lever has been attached to the first connector housing and restricts a further rotation of the lever positioned at the end position toward a direction away from the start position. The attaching position is set in a vicinity of the end position outside of the ordinary rotation range.

In this way, since the attaching position of the lever is set in a vicinity of the end position outside of the ordinary rotation range, a waiting state for accepting the cam pin can be made ready only by rotating the lever from the attaching position to the start position thorough the end position. In other words, since the attaching position (that is, a uncoupling position) of the lever is set at a position far from the start position, the lever set at the start position will not be returned back to the attaching position by error.

Note that, the lever has already completed a required function (connecting function) when the lever is positioned at the end. For this reason, there is no practical adverse affect even if the lever is rotated back to the attaching position by error from the end position.

Furthermore, since the stopper is provided corresponding to the end position, the lever will not be rotated back to the attaching position by error. As a result, the lever will not be rotated back to the attaching position by error, and the uncoupling of the lever under when the first and second connector housings are connected cannot occur. Therefore, when the first and second connector housings are to be disconnected, the first and second connector housings can be uncoupled by using the lever which has not uncoupled.

It is preferable that the lever connector further comprises: a cover which is attached to the first connector housing after the lever has been attached to the first connector housing and the stopper is provided on the cover.

In this way, since the stopper is provided on the cover which is attached to the first connector housing after the lever has been attached to the first connector housing, the attaching process of the lever onto the female connector housing can be done easily before attaching the cover. And, since the cover is attached after the lever has been attached to the first connector housing, the stopper can effectively restrict the further rotation of the lever beyond the end position.

DESCRIPTION OF THE PREFERRED EMBODIMENT

Figure 1:
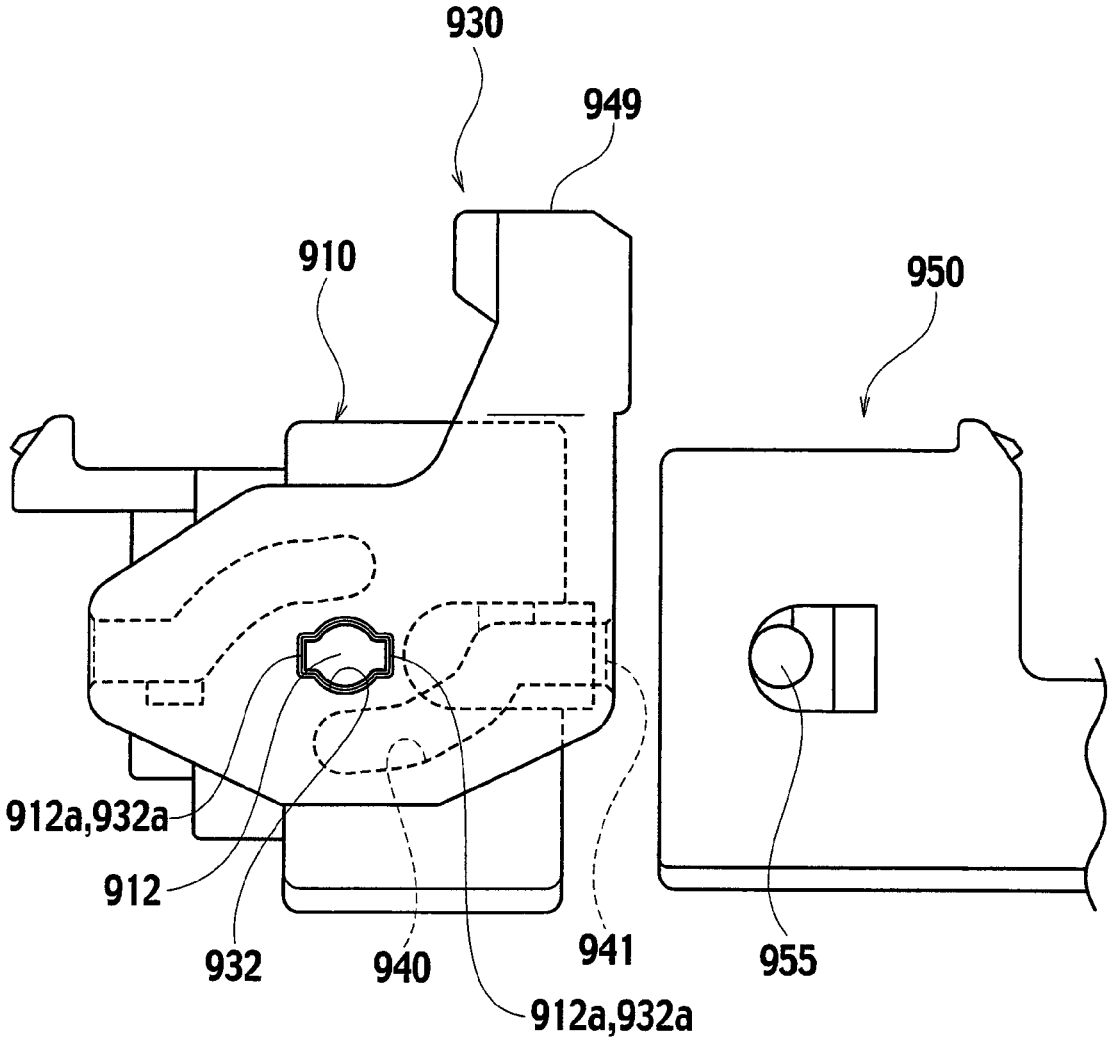
FIG. 1 PRIOR ART
FIG. 1 is a side view showing one example of a conventional lever type connector (a state before a cam pin is inserted into a cam groove)
Figure 2:
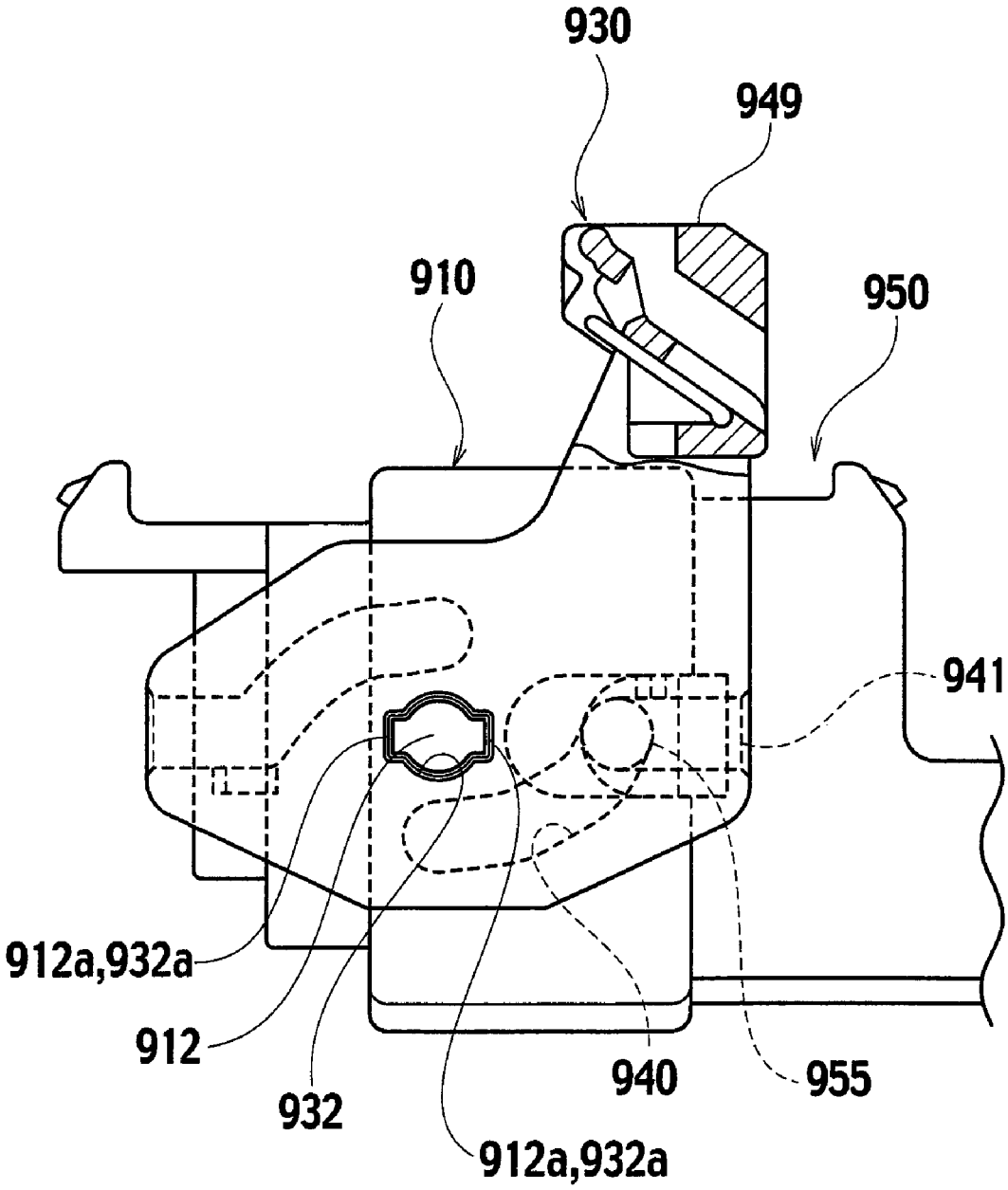
FIG. 2 PRIOR ART
FIG. 2 is a side view showing the example of a conventional lever type connector (an initial stage of connecting in which a cam pin is inserted into a cam groove)
Figure 3:
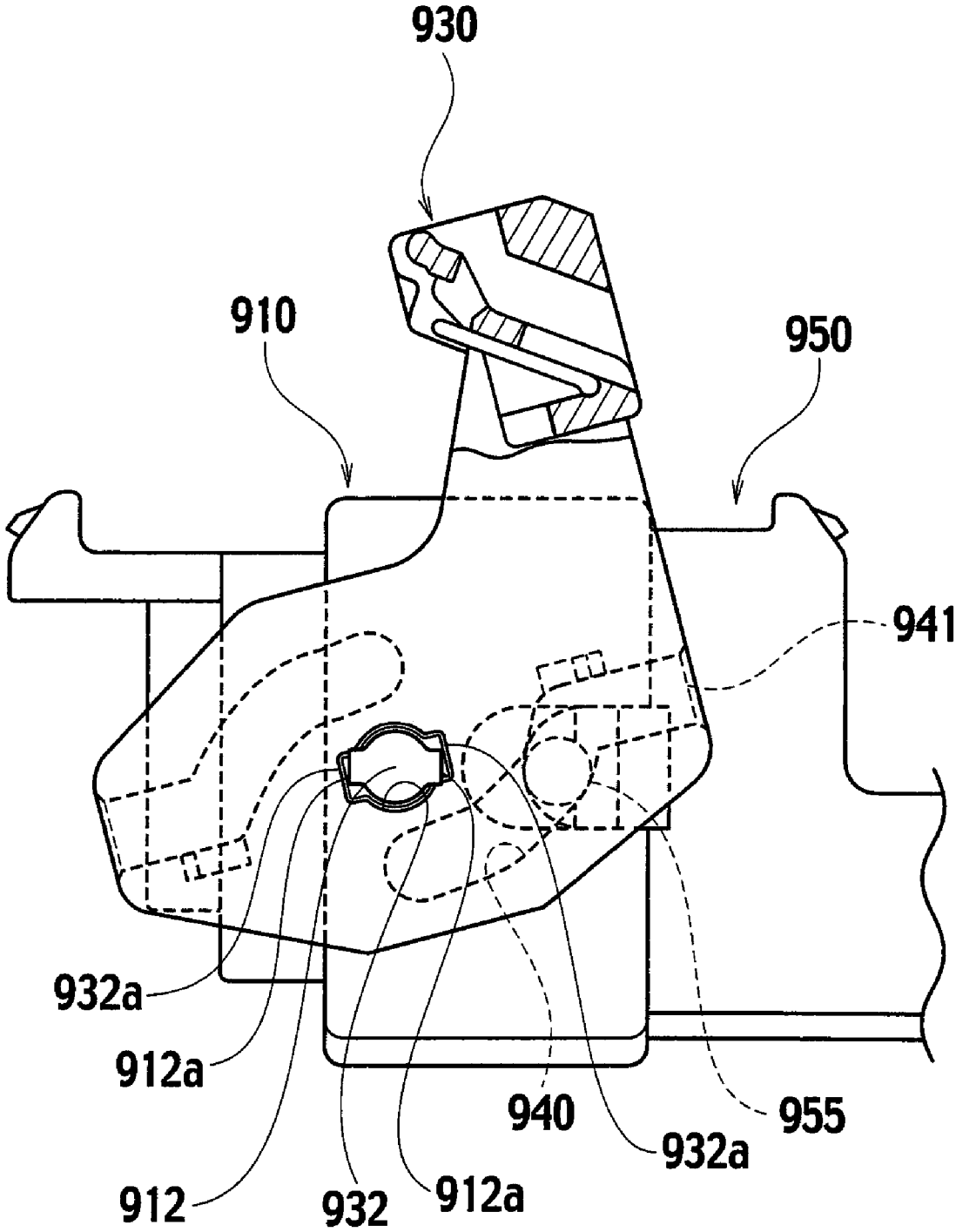
FIG. 3 PRIOR ART
FIG. 3 is a side view showing the example of a conventional lever type connector (a state of start rotating a lever)
Figure 4:
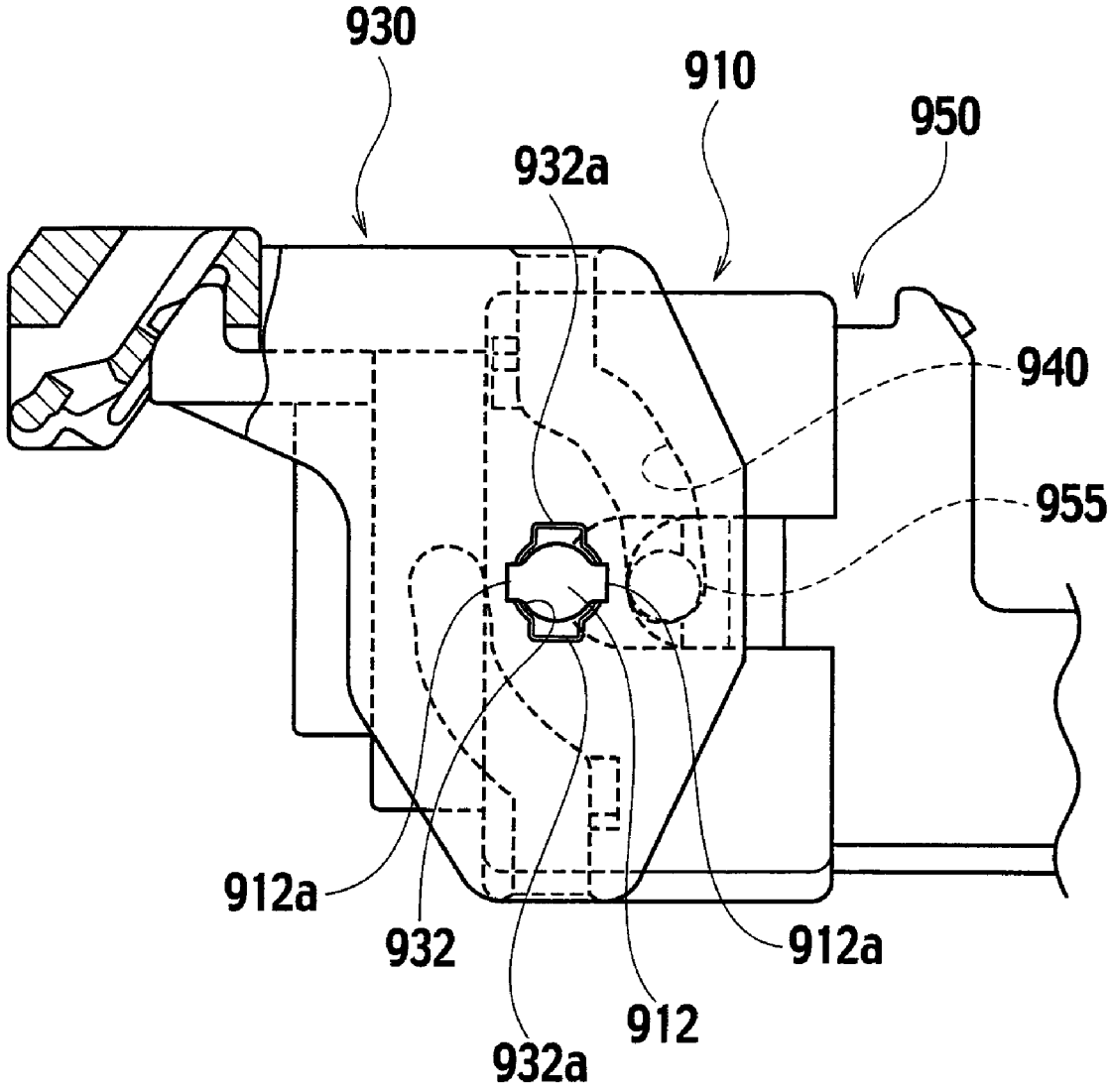
FIG. 4 PRIOR ART
FIG. 4 is a side view showing the example of a conventional lever type connector (a final stage of connecting in which a lever is rotated to an end position)

In the following, an embodiment of the present invention will be described with references to the drawings.

A lever type connector of this embodiment mainly comprises a female connector 100, a male connector 200, a front holder 300, a movable plate (movable guide member) 400, a lever 500, and a cover 600. The female connector 100 and the male connector 200 are to be connected with each other. The front holder 300 is attached inside an aperture 102 of a housing (female connector housing) 101 of the female connector 100. The movable plate 400 is attached inside a hood 202 of a connector housing (male connector housing) 201 of the male connector 200. The movable plate 400 is slidable in a connecting direction (a forward and backward direction) within the hood 202. The lever 500 is attached to an outer side of the female connector 100. The cover 600 is attached to the female connector 100 in order to cover a backside of the female connector 100.

Metallic terminals (female terminals: not shown in the figures) are installed within a cavity of the female connector housing 101. The hood 202 of the male connector 200 is inserted inside the aperture 102 of the female connector housing 101. The metallic terminals, each of which is prevented from pulling-out by its lance, are unfailingly held by the front holder 300 attached to the female connector 100 from its front side.

Furthermore, metallic terminals (male terminals: not shown in the figures) are installed within a cavity of the male connector housing 201. The hood 202, which is extending towards a front side, is inserted inside the aperture 102 of the female connector 100. The metallic terminals, each of which is held by its lance, is protected by the movable plate 400 installed slidably within the hood 202 of the male connector 200 from its front side.

The movable plate 400 holds the metallic terminals of the male connector 200 at their regular positions while connecting the female and mail terminals in order to prevent deformation of the terminals. Furthermore, the movable plate 400 is slid towards a backside by being pushed by the female connector 100 in order to guide the connecting between the female and mail terminals.

A lever attaching plane 111, which is formed one step lower than surrounding plane, is provided on a pair of outer side planes 110 of the female connector housing 101, respectively. A respective side plate 510 of the lever 500 is coupled on each of the lever attaching face 111.

The lever 500 is used for connecting the connector and has an arch-shape. The lever 500 has a pair of side plates 510, each of which has an approximately circular-shape, and a knob 530 bridging the pair of side plates 510. An axial hole 512, a slit 513, and a cam groove 514 are formed on each of the side plate 510. The respective cam groove 514 is formed on an inner face of the respective side plate 510. A respective entry gate 514*a* of the respective cam groove 514 is opening at a circumferential edge of the respective side plate 510.

The respective slit 513 extends in an arc shape around the axial hole 512 (a rotation center of the lever 500). The respective slit 513 has a tab 513*a* on its inner edge. The respective slit 513 extends in an overall rotating angle range of the lever 500 (including an attaching angle of the lever 500) around the respective axial hole 512 (center of the angle). The tab 513*a* extends in an ordinary rotating angle range of the lever 500. The ordinary rotating angle range (ordinary rotating range) will be described below.

The respective cam groove 514 extends in a prescribed angle range around the respective axial hole 512 (center of the angle). A distance from the axial hole 512 to the cam groove 514 decreases gradually from the entry gate 514*a* towards an opposite end, respectively.

A pin 112, to which the axial hole 512 of the lever 500 is to be rotatably coupled, is provided on each of the lever attaching planes 111 on both sides of the female connector housing 101. The lever 500 is rotatably attached to the female connector housing 101 by coupling the pins 112 with the axial holes 512. The lever 500 is rotatable in a prescribed angle range, which is defined by a length of the slit 513, around the pin 112 (center of the angle). A respective guiding slit 114 is provided on a front side of the respective pin 112. Each of the guiding slits 114 extends straight from the entry gate 114*a* at a front end to a vicinity of the pin 112.

In addition, a hook 113 is provided around the pin 112 on each of the lever attaching plane 111. Each hook 113 is slidably coupled with the slit 513. A tab 113*a*, which hooks the tab 513*a* of the slit 513, is provided at a tip end of the hook 113. The uncoupling of the lever 500 from the pins 112 is prevented by engagement between the tab 113*a* and the tab 513*a*.

Furthermore, two tabs 515, 516 are provided on a circumferential edge of the respective side plate 510 of the lever 500 at some interval.

Figure 7:
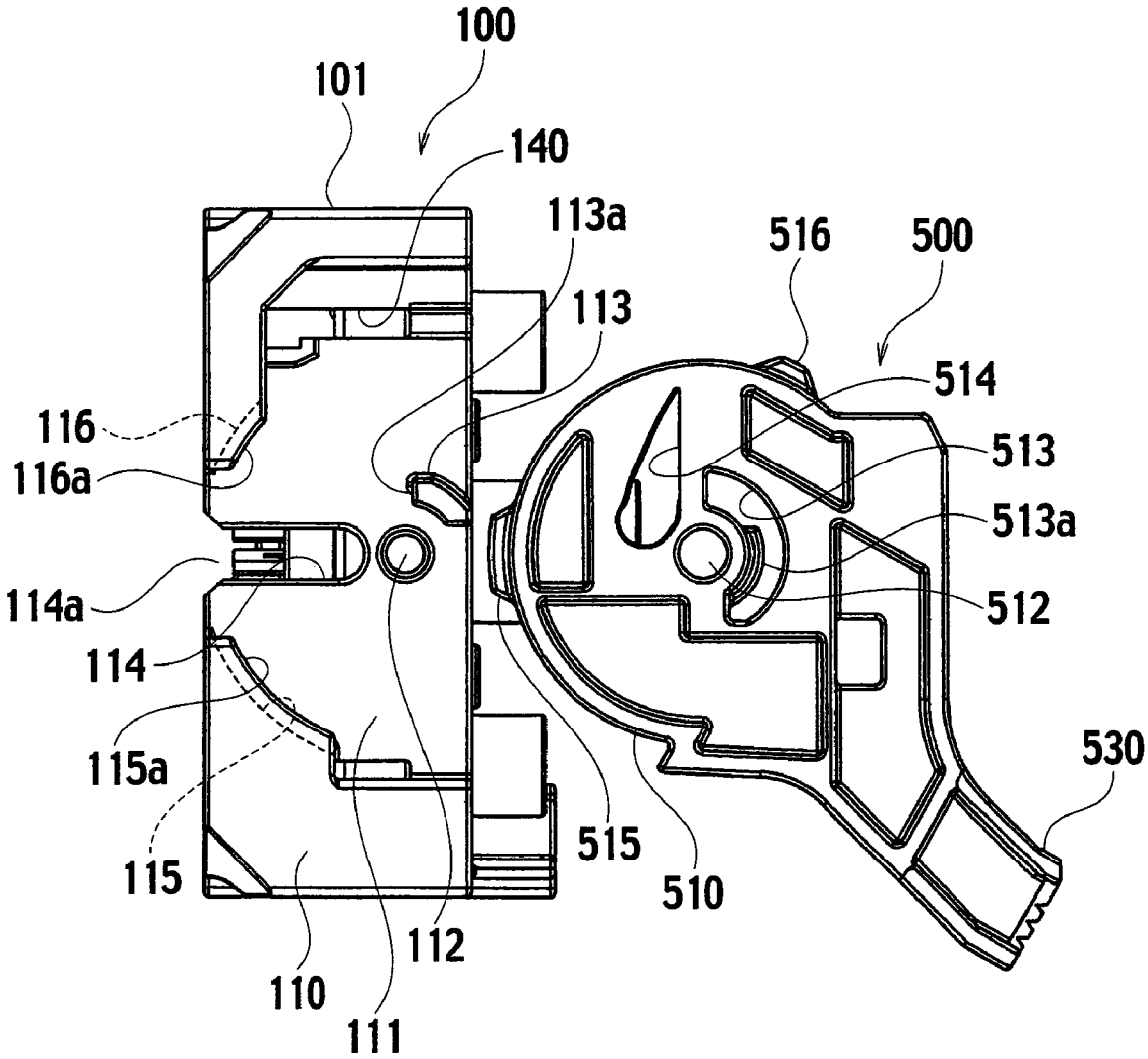
FIG. 7 is a side view showing a state before attaching a lever to the female connector.

Furthermore, curved walls 115, 116, which guide the circumferential edge of the respective side plate 510 are provided on a circumferential edge of the respective lever attaching face 111 of the female connector housing 101. The curved walls 115, 116 are provided on both sides of the guiding slit 114 respectively (FIG. 7). Flanges 115*a*, 116*a* extends from edges of the curved walls 115, 116 respectively in parallel to the respective lever attaching face 111. The uncoupling of the lever 500 from the female connector housing 101 is prevented by engagement between the flanges 115*a*, 116*a* and the tabs 515, 516. In other words, arched grooves are formed in ranges of the flanges 115*a*, 116*a* in order to hold the tabs 515, 516 slidably.

Figure 5:
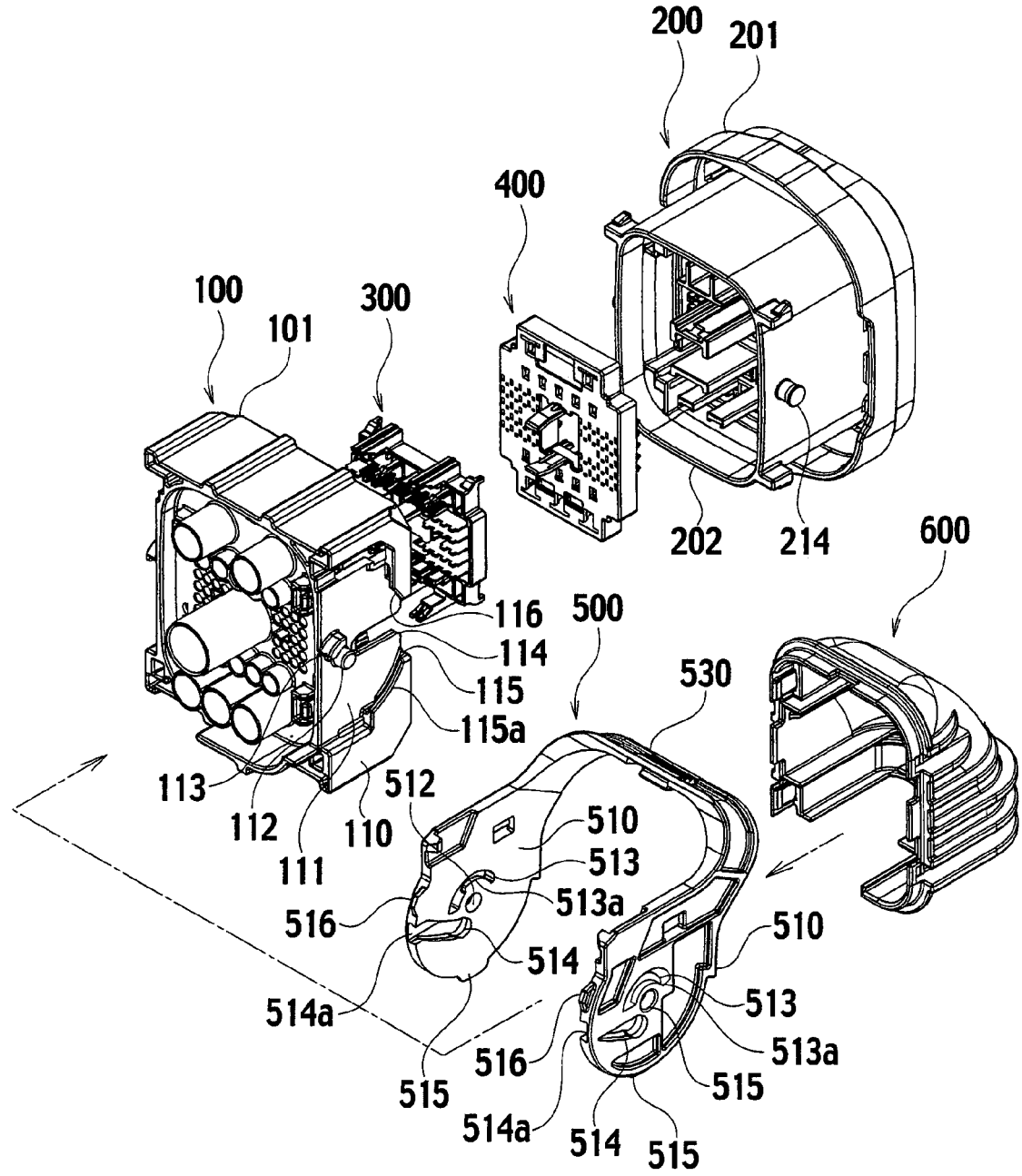
FIG. 5 is an exploded perspective view of a lever type connector of one embodiment of the present invention.

As shown in FIG. 5, a pair of cam pins 214, which is guided by the cam grooves 514 of the lever 500, is provided on a side face of the hood 202 of the male connector housing 201. The pair of cam pins 214 is guided by the cam grooves 514 while sliding through the guiding slit 114 of the female connector housing 101.

In the present embodiment of the lever type connector, the attaching position of the lever 500 onto the female connector housing 101 is determined in a special position in relation to the ordinary rotating range of the lever 500. This point will be described hereinafter with an assembling procedure.

Figure 8:
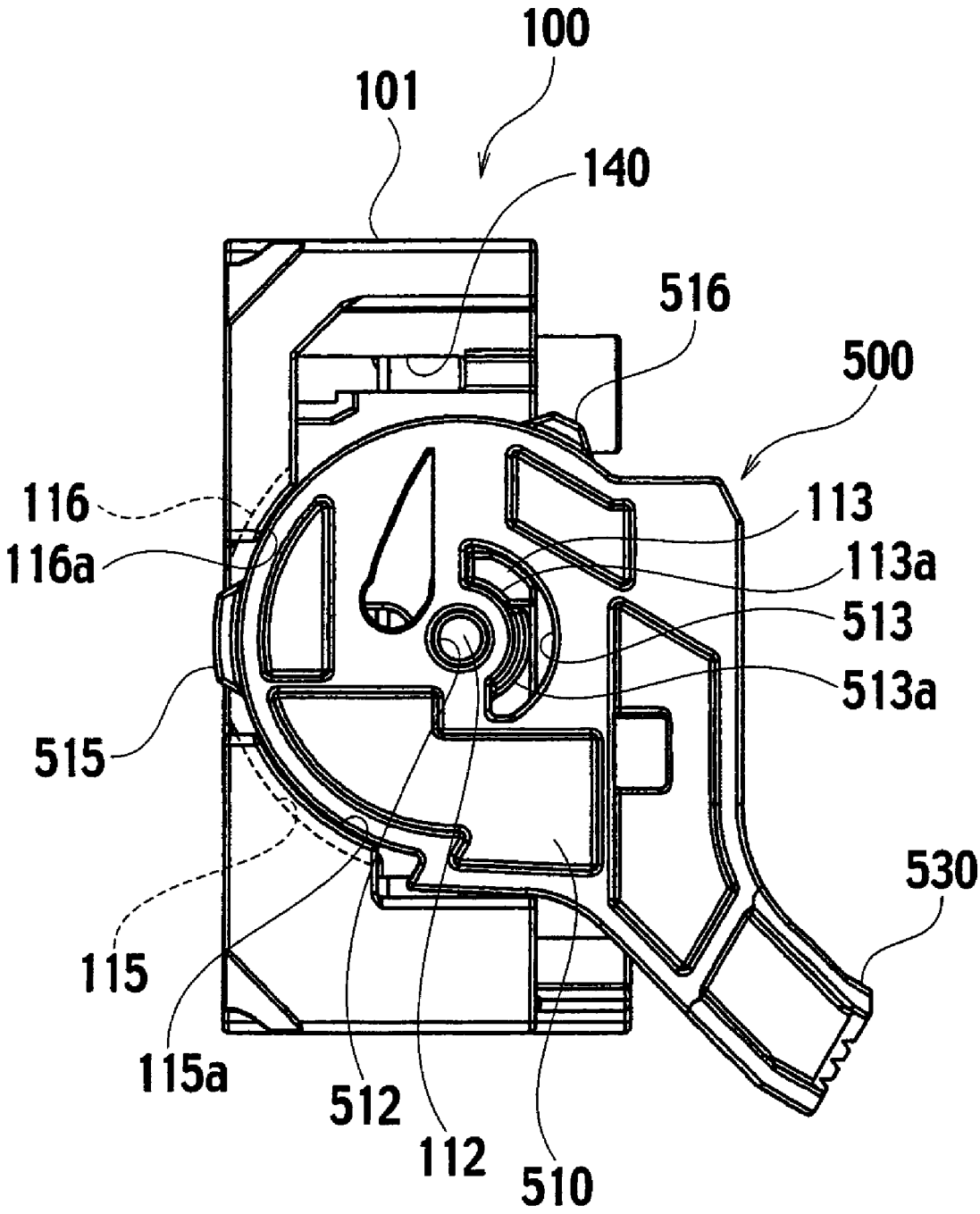
FIG. 8 is a side view showing a state after attaching the lever to the female connector.

FIG. 7 and FIG. 8 show a positional relationship between the female connector housing 101 and the lever 500 at attaching the lever 500 onto the female connector housing 101. The positions of the tabs 515, 516 of the lever 500 is unmatched with the positions of the flanges 115*a*, 116*a* of the female connector housing 101 respectively when the lever 500 is set at the attaching position. In addition, the position of the hook 113 and the position of the slit 513 are coincident, but the hook 113 and the tab 513*a* of the slit 513 are unmatched. In other words, holding mechanism (the tabs 113*a*, 513*a*, 515, 516 and the flanges 115*a*, 116*a*) is in an unholding state when the lever 500 is set at the attaching position.

In this state, the axial holes 512 of the lever 500 are coupled with the pins 112 of the female connector housing 101 respectively. When the lever 500 is attached onto the female connector housing 101, the lever 500 is bent in order to widen the distance between the pair of the side plates 510. As the axial holes 512 are coupled with the pins 112 respectively, both of the side plates 510 of the lever 500 are attached onto the lever attaching faces 111 respectively. Here, the hooks 113 are inserted into the slits 513 respectively, but the tabs 113*a* of the hook 113 and the tabs 513*a* of the slit 513 are unmatched. FIG. 8 shows a state immediately after the attaching of the lever 500.

Figure 9:
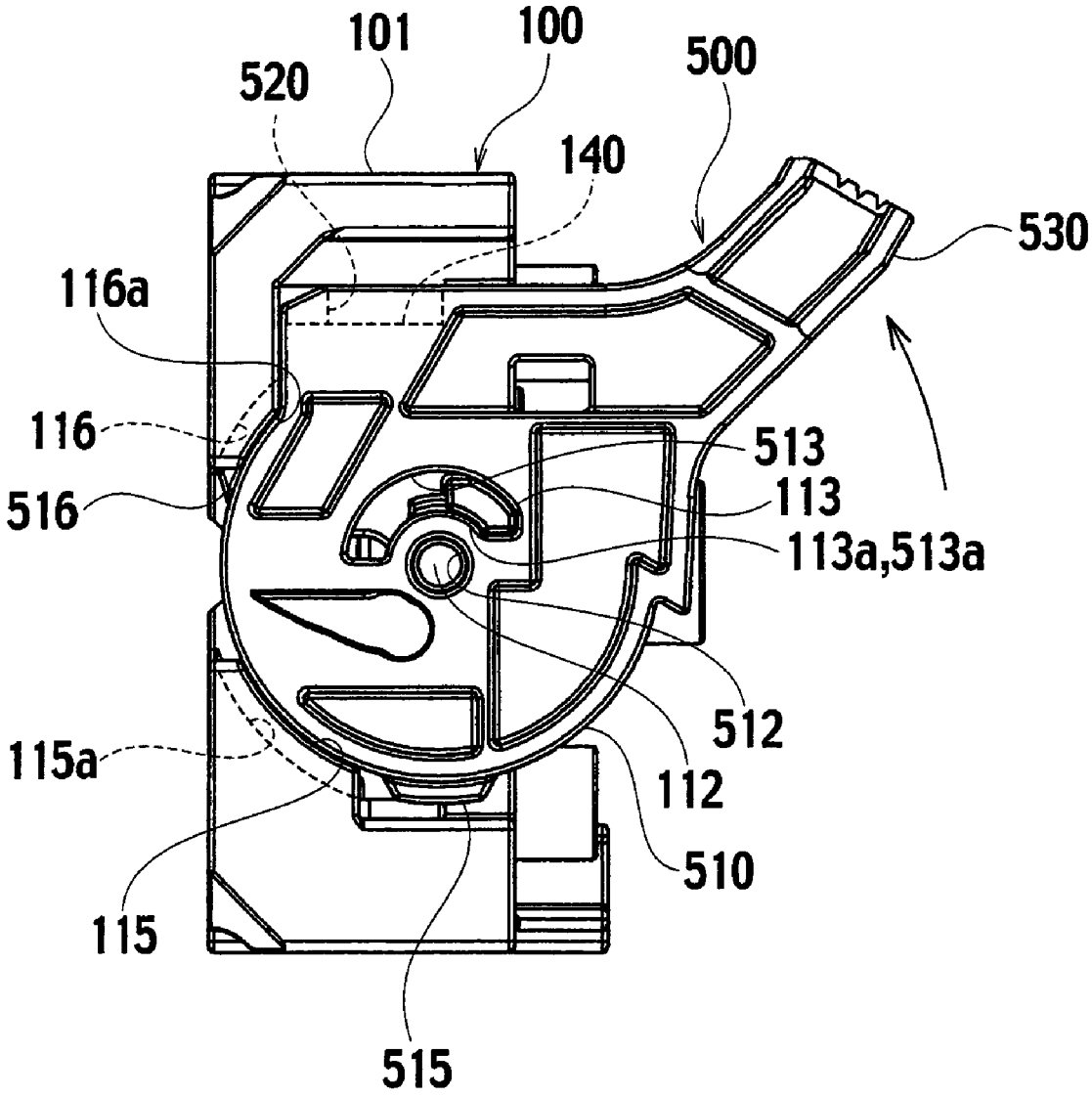
FIG. 9 is a side view showing a state in which the lever is rotated to a start position.

And then, the lever 500 is rotated in a direction of an arrow in FIG. 9 until the hooks 113 hits opposite ends of the slits 513 respectively. The tabs 113*a* of the hooks 113 and the tabs 513*a* of the slit 513 are overlapped respectively, and the lever 500 is held by the hooks 513. In addition, the tabs 515, 516 on the circumferential edges of the side plates 510 of the lever 500 are held by the flanges 115*a*, 116*a* respectively.

Figure 6:
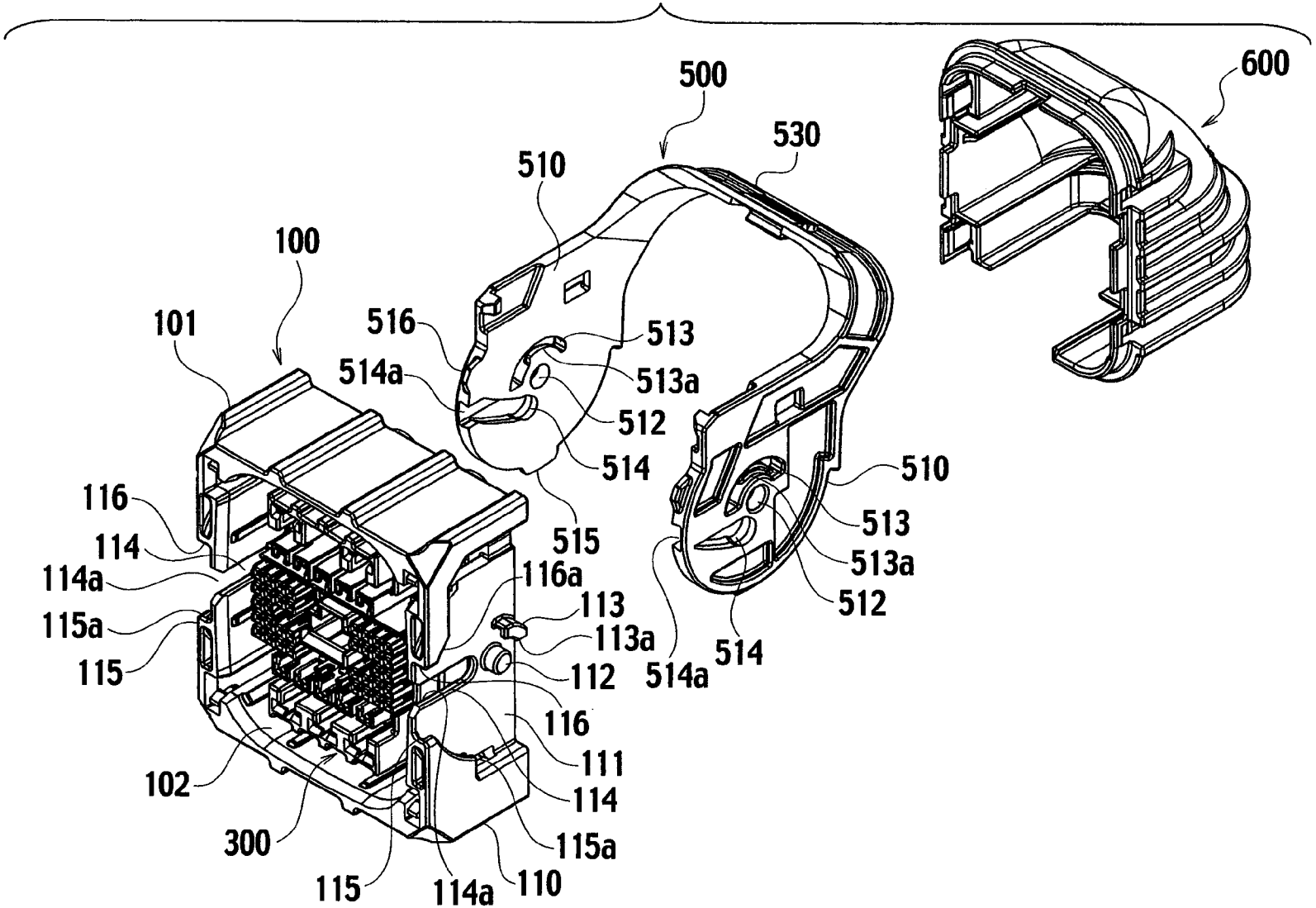
FIG. 6 is an exploded perspective view showing a configuration of a female connector of the embodiment.

A position at which the hooks 113 hit the end of the slits 513 is a start position of the rotation of the lever 500. The entry gates 514*a* of the cam grooves 514 and the entry gates 114*a* of the guiding slits 114 are matched when the lever 500 is positioned at the start position (FIG. 6), and it becomes possible to insert the cam pins 214 of the male connector housing 201 into them.

Figure 10:
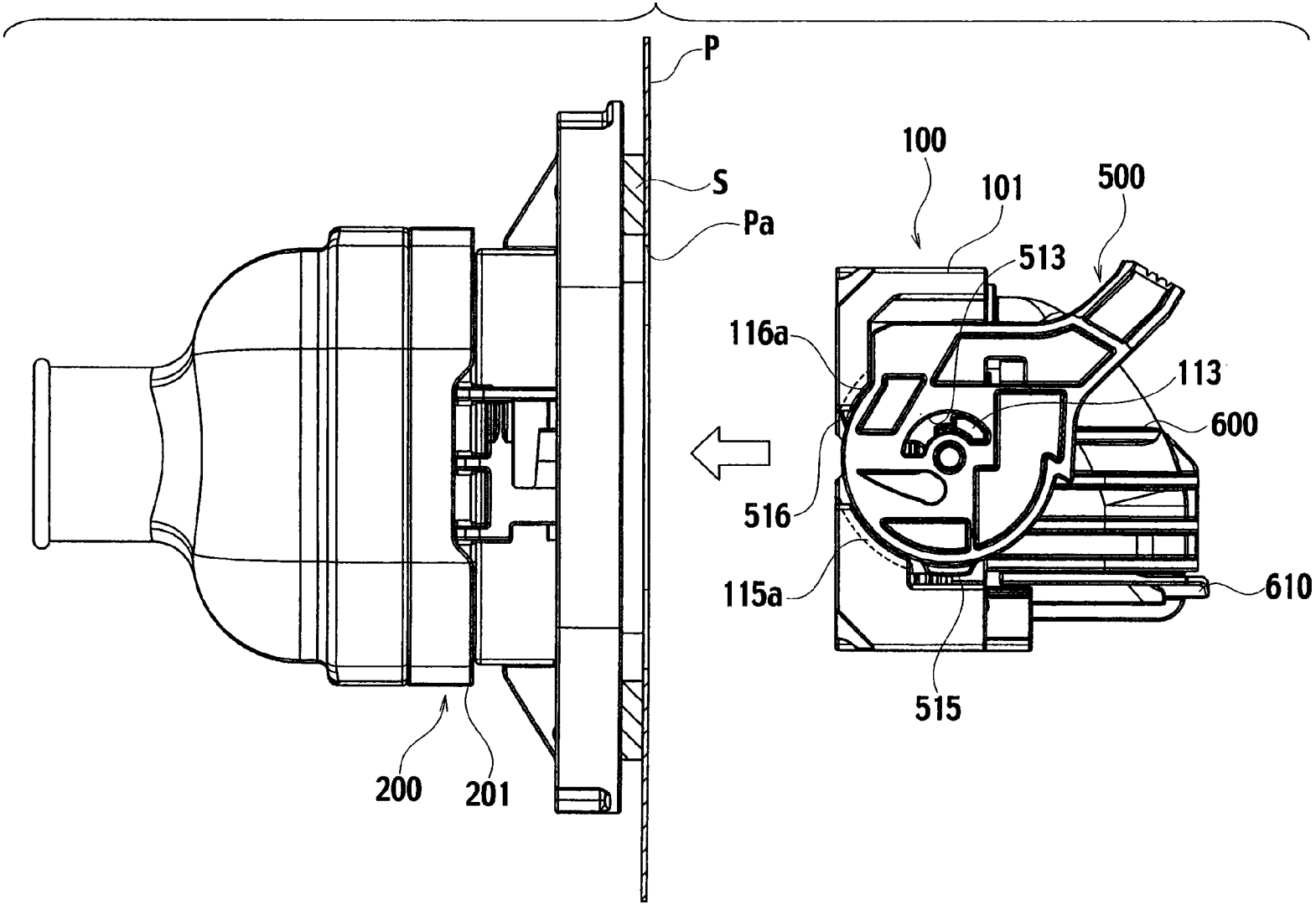
FIG. 10 is a side view showing a state in which the female and male connectors are set face to face with a car body panel therebetween.

And then, when the pair of connectors 100 and 200 are to be connected, as shown in FIG. 10, the female connector 100 with the lever 500 set at the start position is positioned against the male connector 200 attached on a car body panel P. In FIG. 10, Pa is an aperture of the car body panel P and S is a sealing member.

Figure 11:
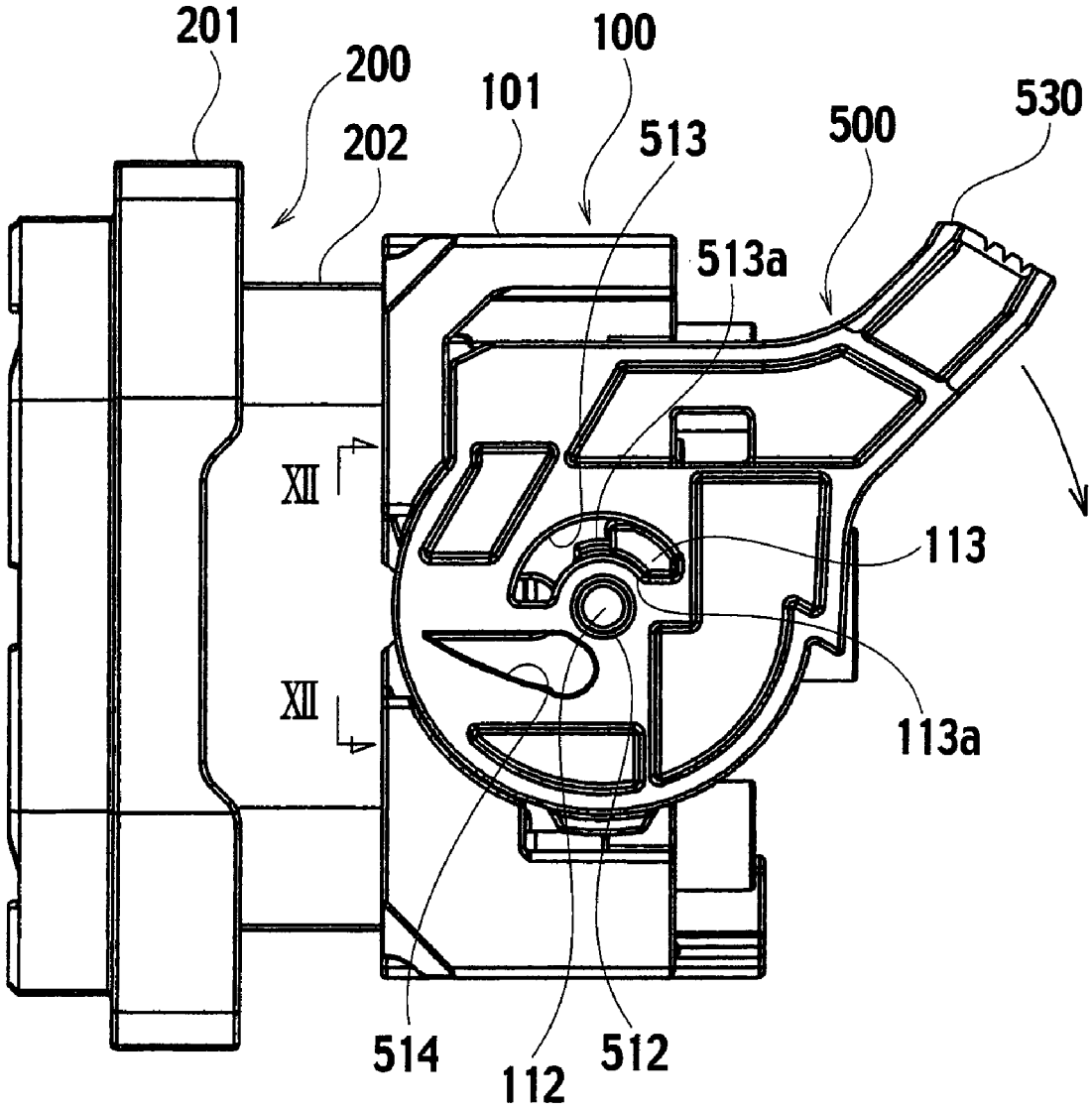
FIG. 11 is a side view showing an initial stage of connecting the female and male connectors.
Figure 12:
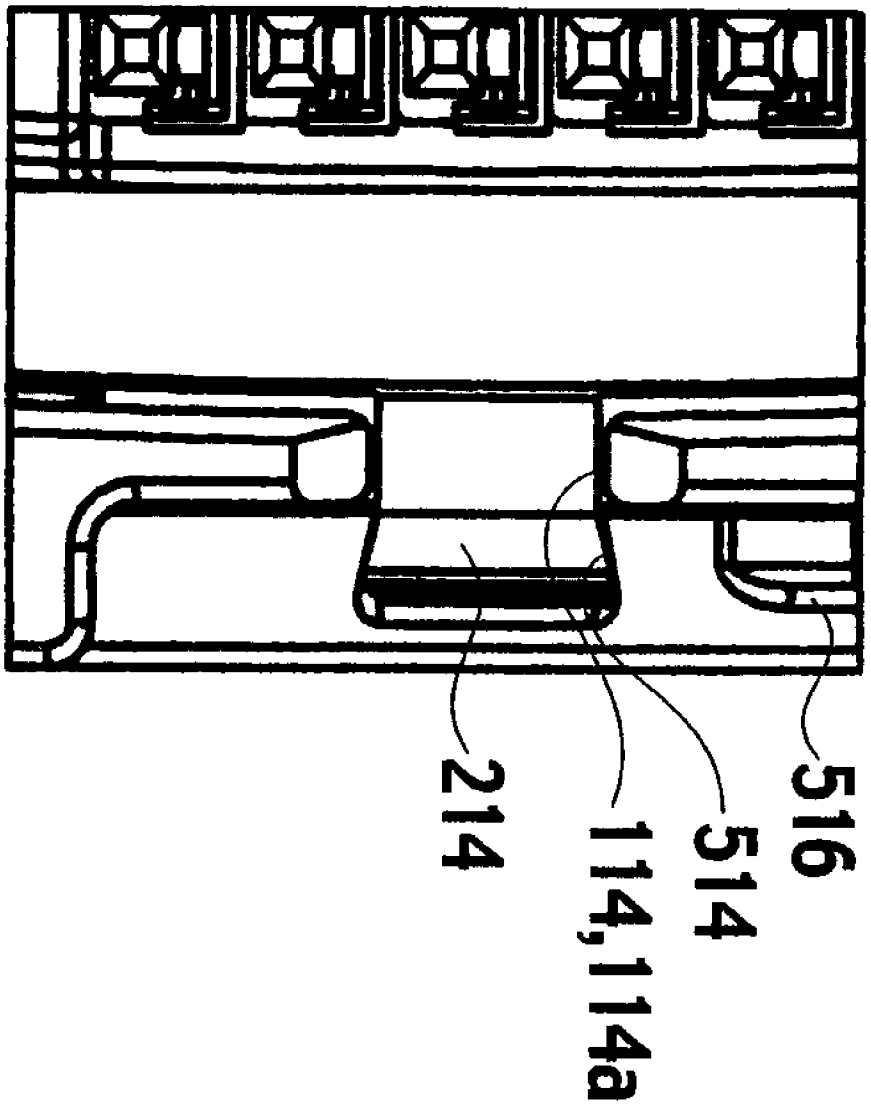
FIG. 12 is a view from a direction of arrows XII-XII in FIG. 11.

In this state, the female connector 100 and the male connector 200 are connected loosely (initial connecting). The cam pins 214 of the male connector housing 201 are entered from the entry gates 114*a*, 514*a* into the guiding slits 114 of the female connector housing 101 and the cam grooves 514 of the lever 500, respectively. FIG. 11 shows a state at this point, and FIG. 12 shows a state in which the cam pins 214 have entered into the guiding slits 114 and the cam grooves 514.

Figure 13:
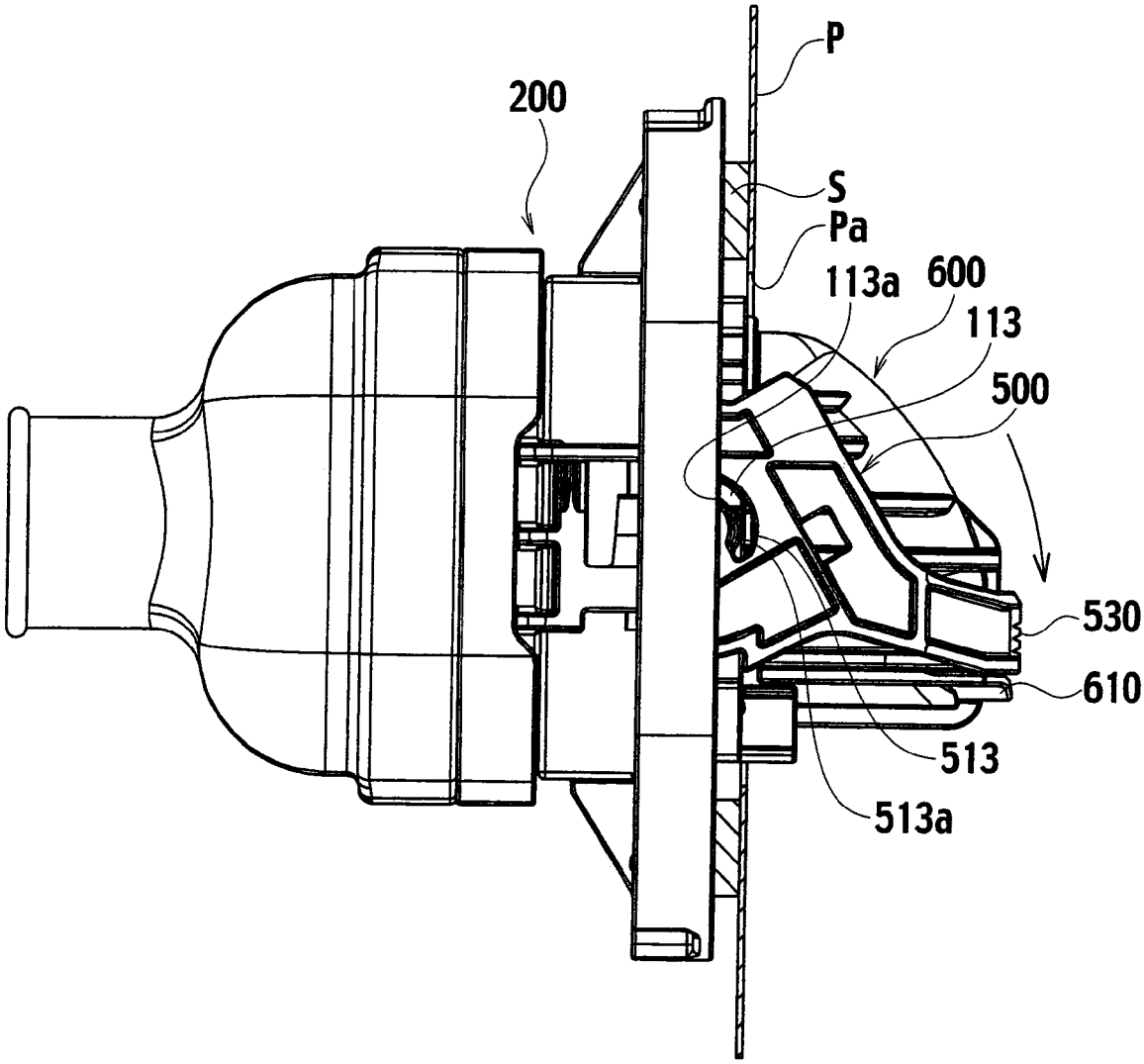
FIG. 13 is a side view showing a state in which the female and male connectors are connected by rotating the lever to an end position.
Figure 14:
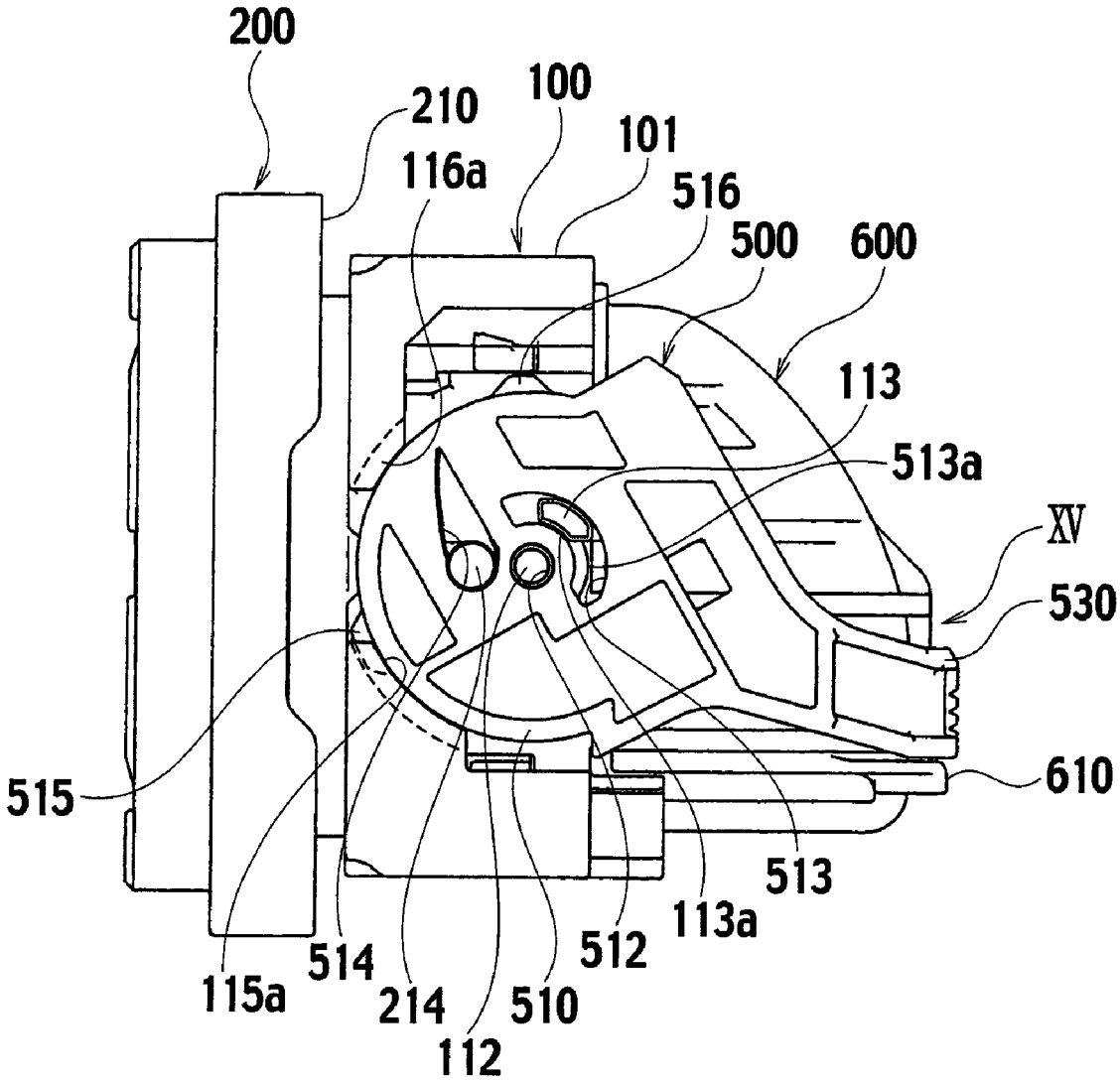
FIG. 14 is a side view showing only the female and male connectors of FIG. 13.

Next, from the state of FIG. 11, the lever 500 is rotated in a direction of an arrow in FIG. 11 using the knob 530, and moved to the position of FIG. 13 and FIG. 14. And then, the connector housings 101, 201 are completely connected by the cam structure between the cam grooves 514 and the cam pins 214. A position of the lever 500 at this point is an end position of the rotation. Note that, in FIG. 13 and FIG. 14, the cover 600 is attached on a backside of the female connector 100. The cover 600 is attached after the installation of metallic terminals and electric wires into the female connector 100 is furnished. The electric wires are collectively lead out to one direction by the cover 600 (downwards in FIG. 13 and FIG. 14).

When the rotation range from the start position to the end position is defined as the ordinary rotation rage for connecting the connector, the attaching position of the lever 500 described above is set outside of the ordinary rotation range.

Consequently, the lever 500 will not be rotated to the attaching position by error during an ordinary operation. The lever 500 can be detached at the attaching position. However, the lever 500 will not be rotated to the attaching position during the ordinary operation, so that the lever 500 will not uncouple even if an external force (a lateral load onto the lever 500 or the like) is applied during the ordinary operation of the lever 500 (the connector connecting operation). Note that, it is also possible to prevent the uncoupling of the lever 500 by setting a coupling structure between the lever 500 and the female connector housing 101 severely and coupling the lever 500 with the female connector housing 101 forcefully. However, the attaching operation of the lever 500 onto the female connector housing 101 becomes cumbersome. In the present embodiment, the attaching position of the lever 500 is set specially so that the attaching operation of the lever 500 does not become cumbersome and the attaching operation can be effectively improved.

Furthermore, in the present embodiment, the attaching position of the lever 500 is set in a vicinity of the end position of the lever 500 outside of the ordinary operation range. Therefore, a waiting state for accepting the cam pins 214 (that is, connecting the connector) can be made ready only by rotating the lever 500 from the attaching position to the start position thorough the end position, as described above. In other words, the attaching position (that is, a uncoupling position) of the lever 500 is set at a position far from the start position, so that the lever 500 set at the start position will not be returned back to the attaching position by error.

Note that, the lever 500 has already completed a required function (connecting function) when the lever 500 is positioned at the end position as shown in FIG. 13 and FIG. 14. For this reason, there is no practical adverse affect even if the lever 500 is rotated back to the attaching position by error from the end position.

Figure 15:
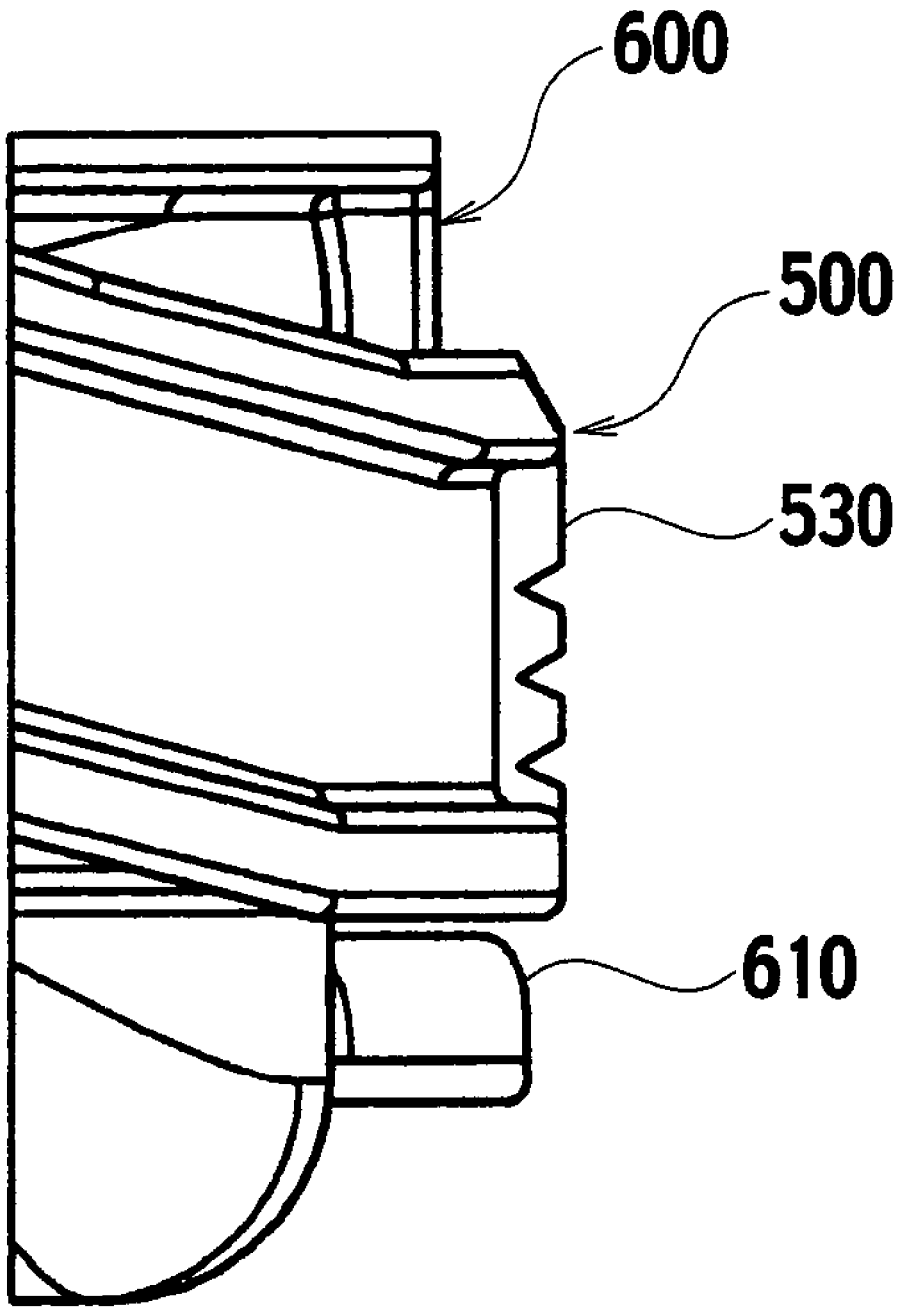
FIG. 15 is an enlarged view of a portion XV shown in FIG. 14.

As shown in FIG. 14, the hooks 113 have not hit the ends of the slits 513 (ends near the attaching position) yet when the lever 500 is positioned at the end position. Therefore, if the rotation of the lever 500 were not regulated, it would be possible to rotate the lever 500 further. However, in the present embodiment, as shown in FIG. 14 and FIG. 15, a stopper 610, which contacts with the knob 530 when the lever 500 is positioned at the end position, is provided on the cover 600 in order to prevent the further rotation of the lever 500 beyond the end position. As a result, the lever 500 will not be rotated back to the attaching position by error, and the uncoupling of the lever 500 under a connected state of the connector cannot occur.

Furthermore, within the ordinary rotating range of the lever 500 from the start position to the end position, the tabs 113*a* of the hooks 113 hold the tabs 513*a* of the slits 513. In addition, the flanges 115*a*, 116*a* hold the tabs 515, 516 alternatively or simultaneously according to the rotation position of the lever 500. Therefore, the uncoupling of the lever 500 can be prevented more surely during the ordinary operation of connecting the connector.

Furthermore, the stopper 610 is provided on the cover 600. Since the cover 600 is attached to the female connector housing 101 after attaching the lever 500 on to the female connector housing 101, the attaching process of the lever 500 onto the female connector housing 101 can be done easily before attaching the cover 600.

On the contrary, the lever 500 is rotated in an opposite direction when the connectors 100 and 200 are to be disconnected. Then, the connector housings 101 and 201 are disconnected by utilizing the principle of leverage between the cam grooves 514 and the cam pins 214. In this case, since uncoupling of the lever 500 never occurs by the stopper 600, the lever 500 is surely held at the end position by the stopper 610. Therefore, the connectors 100 and 200 can be uncoupled by using the lever 500 which has not uncoupled. Note that, in the above embodiment, the stopper 610 is provided on the cover 600. However, the stopper 600 may be provided at anywhere else.

What is claimed is:

1. A lever type connector, comprising:

first and second connector housings to be connected with each other, a lever which is rotatably attached to the first connector housing and has cam grooves; and cam pins which are provided on the second connector housing and guided by the cam grooves respectively;

wherein connecting or disconnecting of the first and second connector housings is assisted by rotating the lever in a state where the cam pins are inserted into the cam grooves respectively;

a position of the lever, at which the cam pins can be inserted into entry gates of the cam grooves respectively, is set as a start position of rotation;

a position of the lever, at which the first and second connector housings are completely connected by rotation of the lever, is set as an end position of rotation; and an attaching position of the lever, at which the lever can be attached to the first connector housing, is set outside of an ordinary rotation range from the start position to the end position.

2. The lever type connector according to claim 1, further comprising:

holding mechanism which is provided between the lever and the first connector housing and prevents uncoupling of the lever when the lever is positioned within the ordinary rotation range, wherein the holding mechanism is configured to make the lever in an unholding state when the lever is positioned at the attaching position.

3. The lever type connector according to claim 2, wherein the holding mechanism has:

a first tab extended from an edge of the lever; and a second tab which is provided on the first connector housing and engaged with the first tab when the lever is positioned within the ordinary rotation range.

4. The lever type connector according to claim 2, wherein the holding mechanism has:

a slit provided on the lever;

a hook which is provided on the first connector housing and inserted within the slit slidably; and a third tab which is provided on an inside edge of the slit and engaged with the hook when the lever is positioned within the ordinary rotation range.

5. The lever type connector according to claim 1, further comprising:

a stopper which is provided on the lever type connector after the lever has been attached to the first connector housing and restricts a further rotation of the lever positioned at the end position toward a direction away from the start position;

wherein the attaching position is set in a vicinity of the end position outside of the ordinary rotation range.

6. The lever type connector according to claim 3, further comprising:

a cover which is attached to the first connector housing after the lever has been attached to the first connector housing;

wherein the stopper is provided on the cover.

* * * * *